US009746806B2

(12) United States Patent
Sato et al.

(10) Patent No.: US 9,746,806 B2
(45) Date of Patent: Aug. 29, 2017

(54) CONFIGURATION FOR AN IMAGE FORMING APPARATUS HAVING AN UPRIGHT RECORDING MEDIUM STORAGE UNIT

(71) Applicant: Brother Kogyo Kabushiki Kaisha, Nagoya-shi, Aichi-ken (JP)

(72) Inventors: Shougo Sato, Nagoya (JP); Shigeharu Katayama, Nagoya (JP); Mitsuko Hanai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/093,659

(22) Filed: Dec. 2, 2013

(65) Prior Publication Data

US 2014/0086659 A1 Mar. 27, 2014

Related U.S. Application Data

(63) Continuation of application No. 12/057,088, filed on Mar. 27, 2008, now Pat. No. 8,600,284.

(30) Foreign Application Priority Data

Mar. 30, 2007 (JP) ..... 2007-091876

(51) Int. Cl.
*G03G 15/00* (2006.01)
*G03G 21/20* (2006.01)
*G03G 21/16* (2006.01)

(52) U.S. Cl.
CPC ..... *G03G 15/6502* (2013.01); *G03G 21/1609* (2013.01); *G03G 21/1685* (2013.01);
(Continued)

(58) Field of Classification Search
CPC ..... G03G 15/6502; G03G 21/1609; G03G 21/1685; G03G 21/20
(Continued)

(56) References Cited

U.S. PATENT DOCUMENTS 4,727,387 A 2/1988 Israely
5,065,197 A 11/1991 Mitsuyama
(Continued)

FOREIGN PATENT DOCUMENTS

JP 2079876 A 3/1990
JP 4333063 A 11/1992
(Continued)

OTHER PUBLICATIONS

Non Final Office Action issued in corresponding U.S. Appl. No. 12/057,102 mailed Mar. 25, 2013.
(Continued)

*Primary Examiner* — Matthew G Marini
(74) *Attorney, Agent, or Firm* — Banner & Witcoff, Ltd.

(57) ABSTRACT

An image forming apparatus includes a recording sheet storage unit for storing recording sheets substantially in an upright position, an image forming unit which forms an image on a recording sheet conveyed from the recording sheet storage unit, and a recording sheet receiving unit for storing the recording sheet conveyed from the image forming unit substantially in an upright position. In this image forming apparatus, a paper conveyance passage for conveying the recording sheet extends upward from a lower portion of the recording sheet storage unit toward the recording sheet receiving unit. The image forming unit positioned on the paper conveyance passage comprises a fixing device and a developer unit at least including a developer carrier, and the fixing device is arranged above the developer unit.

16 Claims, 7 Drawing Sheets

(52) U.S. Cl.
CPC ..... *G03G 21/20* (2013.01); *G03G 2221/1639* (2013.01); *G03G 2221/1678* (2013.01)

(58) Field of Classification Search
USPC ..... 399/405, 119, 220, 120, 400, 393, 107, 399/116, 388, 25, 27, 106; 400/624, 691, 400/692, 693; 347/101, 104, 108; 348/375, 201.2
See application file for complete search history.

(56) References Cited

U.S. PATENT DOCUMENTS

| | | | | |
|---|---|---|---|---|
| 5,653,437 | A | 8/1997 | Inoue et al. | |
| 5,741,080 | A * | 4/1998 | Tomoda | B41J 17/32 400/208 |
| 6,945,720 | B2 | 9/2005 | Maekawa et al. | |
| 7,257,349 | B2 | 8/2007 | Kitozaki | |
| 7,502,577 | B2 | 3/2009 | Kitozaki et al. | |
| 7,636,528 | B2 | 12/2009 | Sato et al. | |
| 7,649,543 | B2 * | 1/2010 | Tanabe | 347/242 |
| 7,686,446 | B2 | 3/2010 | King et al. | |
| 7,853,174 | B2 * | 12/2010 | Sato | G03G 15/0834 399/110 |
| 8,116,659 | B2 * | 2/2012 | Sato | G03G 15/0834 399/110 |
| 2002/0064395 | A1 | 5/2002 | Funayama et al. | |
| 2005/0135841 | A1 | 6/2005 | Murakami et al. | |
| 2005/0175373 | A1 | 8/2005 | Okamoto et al. | |
| 2005/0281581 | A1 | 12/2005 | Kitozaki | |
| 2005/0281591 | A1 | 12/2005 | Kitozaki et al. | |
| 2006/0024094 | A1 | 2/2006 | Uehara | |
| 2006/0083564 | A1 | 4/2006 | Yazawa et al. | |
| 2006/0221170 | A1 * | 10/2006 | Sato et al. | 347/138 |
| 2007/0154237 | A1 * | 7/2007 | Okamoto et al. | 399/119 |
| 2010/0061757 | A1 | 3/2010 | Sato et al. | |

FOREIGN PATENT DOCUMENTS

| | | | |
|---|---|---|---|
| JP | 5113720 | A | 5/1993 |
| JP | 08-002769 | | 1/1996 |
| JP | 08-259076 | | 10/1996 |
| JP | 2003-302889 | | 10/2003 |
| JP | 2005199721 | A | 7/2005 |
| JP | 2006030958 | A | 2/2006 |
| JP | 2006-205541 | | 8/2006 |
| JP | 2006276775 | A | 10/2006 |

OTHER PUBLICATIONS

Office Action in related U.S. Appl. No. 12/057,103 mailed Sep. 21, 2012.
Office Action in related U.S. Appl. No. 12/057,103 mailed Jun. 13, 2012.
Decision of Patent Grant for Japanese patent application No. 2007-091876 mailed Feb. 28, 2012.
Notification of Reasons for Refusal for Japanese patent application No. 2007-091876 mailed Dec. 6, 2011.
Notification of Reasons for Refusal for Japanese patent application No. 2007-092115 mailed Dec. 6, 2011.
Notification of Reasons for Refusal for Japanese patent application No. 2007-092115 mailed Sep. 6, 2011.
Notification of Reasons for Refusal for Japanese patent application No. 2007-091876 mailed Sep. 6, 2011.
Office action in corresponding U.S. Appl. No. 12/057,102 mailed Nov. 22, 2010.
Non-Final Office Action received in corresponding U.S. Appl. No. 12/057,102 issued Dec. 6, 2013.
Final Office Action received in corresponding U.S. Appl. No. 12/057,102 issued Aug. 23, 2013.
Final Office Action received in corresponding U.S. Appl. No. 12/057,088 issued Sep. 28, 2012.
Non-Final Office Action received in corresponding U.S. Appl. No. 12/057,088 issued May 30, 2012.
Non-Final Office Action received in corresponding U.S. Appl. No. 12/057,088 issued Nov. 22, 2010.

* cited by examiner

CONFIGURATION FOR AN IMAGE FORMING APPARATUS HAVING AN UPRIGHT RECORDING MEDIUM STORAGE UNIT

CROSS REFERENCE TO RELATED APPLICATIONS

This application is a continuation of U.S. patent application Ser. No. 12/057,088 filed on Mar. 27, 2008, which claims the foreign priority benefit under Title 35, United States Code, §119 (a)-(d) of Japanese Patent Application No. 2007-091876 filed on Mar. 30, 2007 in the Japan Patent Office. The disclosures of the above noted applications are hereby incorporated by reference in their entirety.

BACKGROUND OF THE INVENTION

The present invention relates to an image forming apparatus such as a printer.

As an image forming apparatus such a printer, an upright-type image forming apparatus is generally known. For example, Japanese Laid-open Patent Application No. 2003-302889 discloses such an upright-type image forming apparatus, in which a paper feed tray (recording sheet storage unit) for storing papers as recording sheets and a paper output tray (recording sheet receiving unit) are arranged back and forth with these trays positioned upright.

In this image forming apparatus, the paper feed tray is arranged higher than the paper output tray, so that a paper conveyance passage extending from a lower part of the paper feed tray to a lower part of the paper output tray for conveying a paper is bent to form a substantially U-shaped configuration. An image forming unit which forms an image on a paper is positioned intermediate of this paper conveyance passage at an extension extending downward from the lower part of the paper feed tray.

More specifically, the image forming unit includes a developer unit equipped with a toner cartridge and a developing roller, and a fixing device for thermally fixing developer that is transferred on a paper. The image forming unit is configured such that the fixing device is positioned below the developer unit on the paper conveyance passage.

However, in this image forming apparatus, because the fixing device is positioned below the developer unit, heat generated at the fixing device rises to the developer unit. This may cause the developer unit to be heated disadvantageously, and as a result heat deterioration of the developer may occur. Further, in this image forming apparatus, the paper conveyance passage extends downward from the lower part of the paper feed tray. In other words, the substantially U-shaped paper conveyance passage is configured such that a vertical distance from the lower part of the paper feed tray to the bottom portion of the conveyance passage is greater than a vertical distance from the bottom portion of the paper conveyance passage to the lower portion of the paper output tray. This causes the vertical distance of the image forming apparatus to be increased around the paper feed tray, so that the paper feed tray is positioned at a higher location. Therefore, it becomes difficult to load papers into the paper feed tray, which leads to deteriorated operationality of the image forming apparatus.

In view of the foregoing drawbacks of the prior art, the present invention seeks to provide an upright-type image forming apparatus which can restrict heat deterioration of the developer as well as an increase in the size of the apparatus in the vertical direction around a recording sheet storage unit, to thereby improve the operationality of the image forming apparatus.

SUMMARY OF THE INVENTION

According to the present invention, there is provided an image forming apparatus comprising a recording sheet storage unit for storing recording sheets substantially in an upright position, an image forming unit which forms an image on a recording sheet conveyed from the recording sheet storage unit, and a recording sheet receiving unit for storing the recording sheet conveyed from the image forming unit substantially in an upright position. In the image forming apparatus, a paper conveyance passage for conveying the recording sheet extends upward from a lower portion of the recording sheet storage unit toward the recording sheet receiving unit. Further, the image forming unit positioned on the paper conveyance passage comprises a fixing device and a developer unit at least including a developer carrier, and the fixing device is arranged above the developer unit.

With this configuration of the image forming apparatus, because the fixing device is arranged above the developer unit at least including the developer carrier, the developer unit is not heated by the heat generated and rising from the fixing device. This can prevent heat deterioration of the developer.

Further, because the paper conveyance passage extends upward from the lower portion of the recording sheet storage unit toward the recording sheet receiving unit, it is possible to restrict an increase in the vertical size of the image forming apparatus around the recording sheet storage unit when compared with the conventional apparatus in which the paper conveyance passage extends downward from the lower part of the recording sheet storage unit. This is advantageous because the user can easily load papers into the recording sheet storage unit and the operationality of the apparatus increases as a result.

According to the present invention, it is possible to prevent heat deterioration of the developer due to heat generated and rising from the fixing device. It is also possible to reduce the size of the whole apparatus in the vertical direction.

Other features and advantages of the present invention will be apparent from the following description taken in conjunction with the accompanying drawings.

BRIEF DESCRIPTION OF THE DRAWINGS

Other objects and aspects of the present invention will become more apparent by describing in detail illustrative, non-limiting embodiments thereof with reference to the accompanying drawings, in which:

FIGS. 3A and 3B are vertical sections of the printer, in which FIG. 3A shows a state where the toner cartridge is attached, and FIG. 3B shows a state where the toner cartridge is ready for removal;

FIGS. 6A and 6B are vertical sections of the printer showing a detachment passage for the process cartridge, in which FIG. 6A shows a starting position for attachment of the process cartridge, and FIG. 6B shows a state where the process cartridge is being attached to the main body casing; and FIGS. 7A and 7B are vertical sections of the printer showing the detachment passage for the process cartridge, in which FIG. 7A is a state where the process cartridge is inserted further from the position as shown in FIG. 6B, and FIG. 7B is an end position for attachment of the process cartridge, at which the attachment of the process cartridge is completed.

DETAILED DESCRIPTION OF THE INVENTION

With reference to the attached drawings, one preferred embodiment of an image forming apparatus according to the present invention will be described below.

Exterior of Printer

Figure 1:
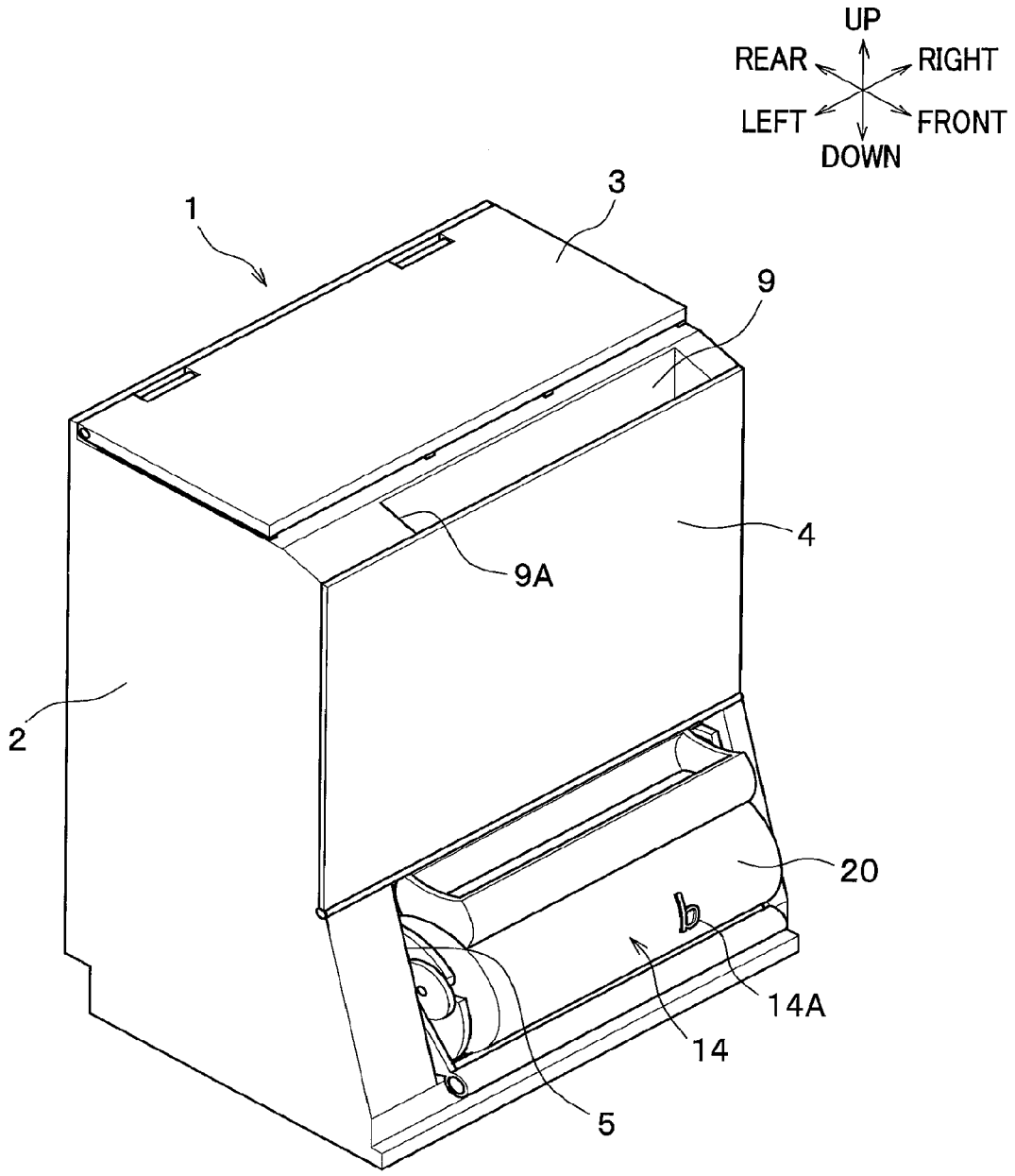
FIG. 1 is a perspective view of a printer as an image forming apparatus according to one embodiment of the present invention.
Figure 2:
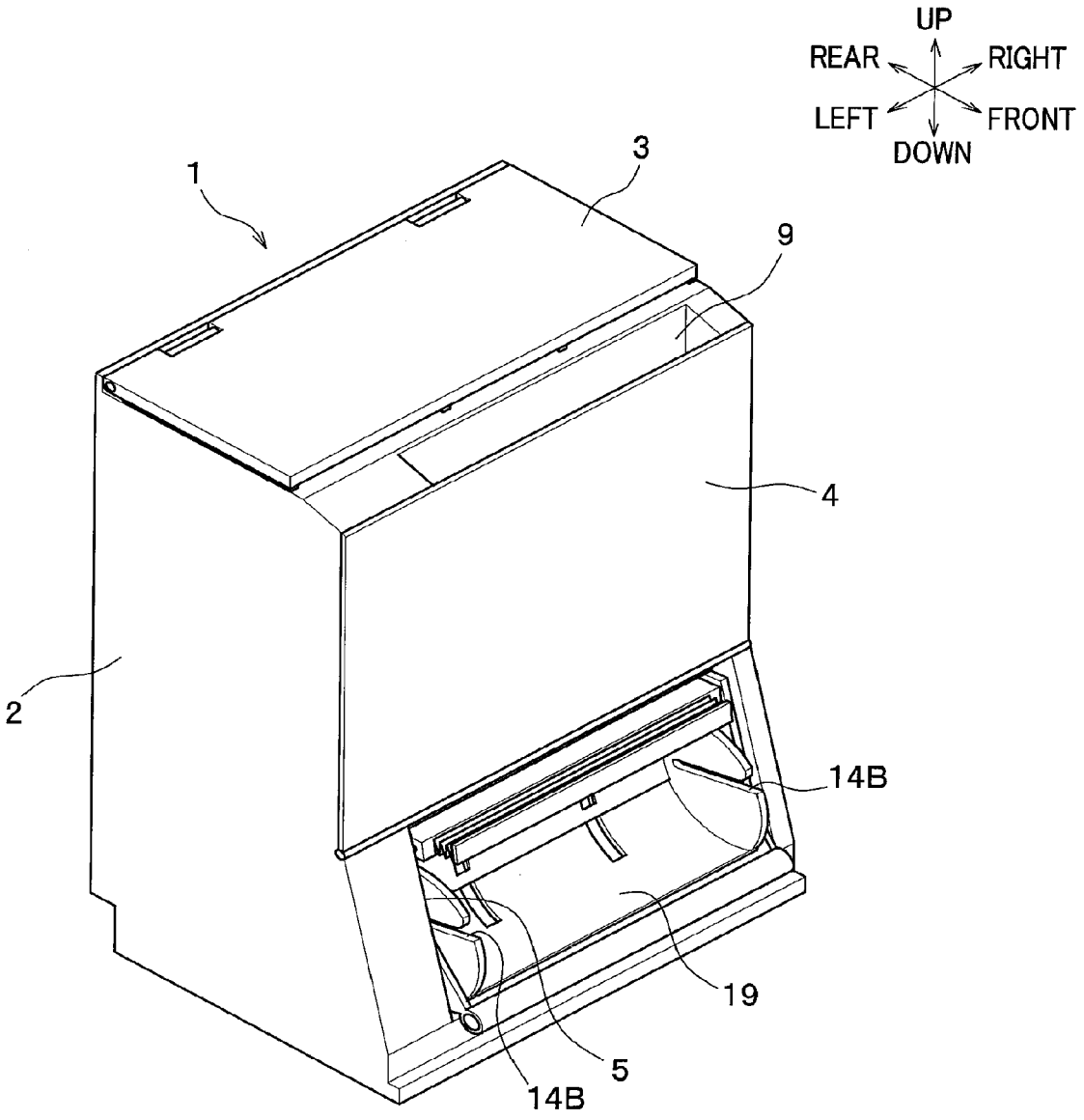
FIG. 2 is a perspective view showing the printer of FIG. 1 with a toner cartridge removed.

As seen in FIGS. 1 and 2, an image forming apparatus according to one embodiment of the present invention is provided as an upright-type printer 1, which has a relatively short length in the front-back direction compared to the right-and-left direction and the height of which is tall. The printer 1 has a main body casing 2. A top cover 3 is provided at an upper part of the main body casing 2, and a front cover 4 is provided at a front upper part of the main body casing 2. Provided at a front lower part of the main body casing 2 is a detachment opening 5 for attachment/detachment of a process cartridge 14 and a toner cartridge 20, which constitute an image forming unit 8 to be described later.

Internal Structure of Printer

Figure 3B:
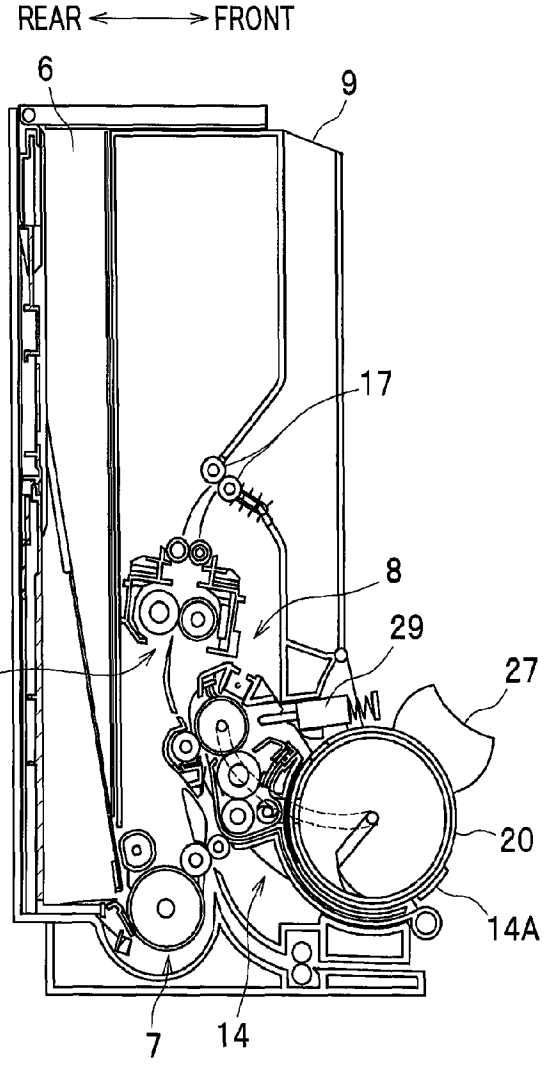
Figure 3A:
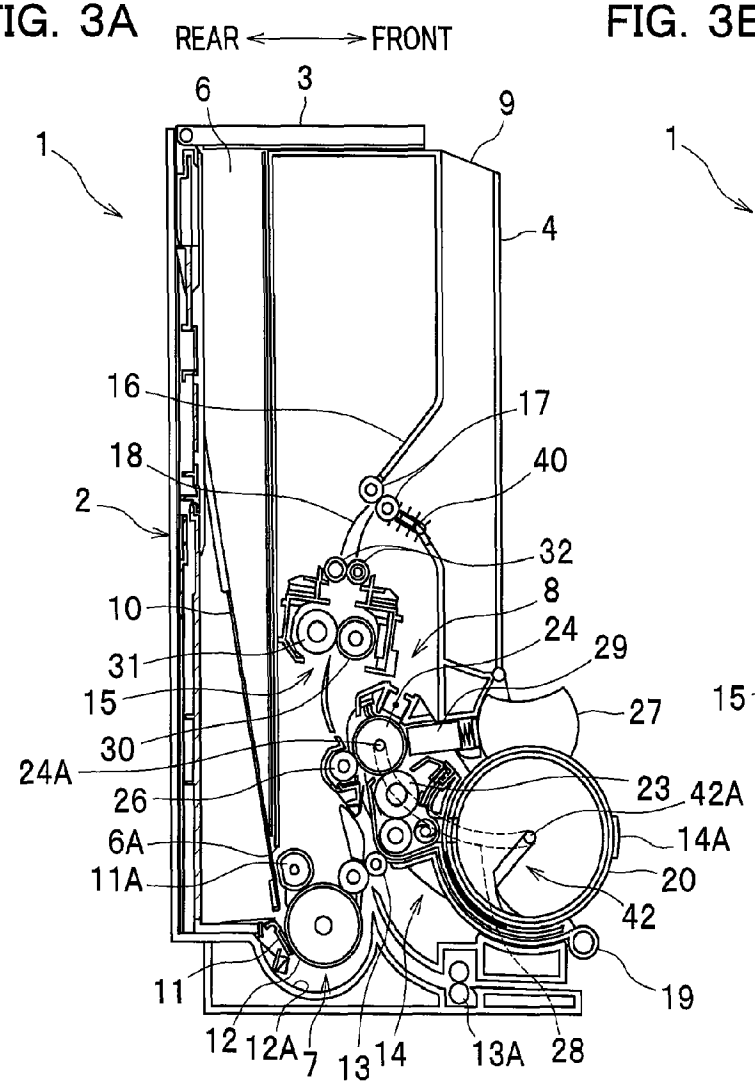

As seen in FIG. 3A, the main body casing 2 includes therein a paper feed tray 6 which is a recording sheet storage unit for storing papers (not shown) as recording sheets substantially in an upright position, a feeder unit 7 which pulls out and feeds a paper stored in the paper feed tray 6, an image forming unit 8 which forms an image on the paper conveyed from the feeder unit 7, and a paper output tray 9 which is a recording sheet receiving unit for pulling and storing therein the recording sheet substantially in an upright position on which is formed the image by the image forming unit 8.

Structure of Paper Feed Tray

The paper feed tray 6 is detachably mounted in the main body casing 2 at the rear portion of the main body casing 2. The paper feed tray 6 can be pulled out upward from the main body casing 2. The rear end portion of the top cover 3 is pivotally supported on the upper part of the paper feed tray 6 so that when the front end portion of the top cover 3 is lifted upward, the upper portion (paper load opening) of the paper feed tray 6 is released. A paper pressure plate 10 is pivotally supported in the paper feed tray 6 so as to press the lower end of the stack of papers toward a paper feed opening 6A provided at the front lower side of the paper feed tray 6. A paper discharge opening formed between two paper output rollers 17, 17 (to be described later) of the paper output tray 9 is positioned higher than the paper feed opening 6A.

Structure of Feeder Unit

The feeder unit 7 is positioned adjacent to the paper feed opening 6A at the front lower side of the paper feed tray 6. The feeder unit 7 includes a separation roller 12 which together with a separation pad 11 holds the lower end of the paper (i.e., leading end of the paper along the conveyance direction) stored in the paper feed tray 6 and pulls out the paper from the paper feed tray 6, a registration roller 13 with which the leading end of the paper that is fed from the separation roller 12 is brought into contact so that the paper is temporarily constrained and thereafter conveyed upward to the image forming unit 8, etc. The registration roller 13 is positioned just above the separation roller 12, and conveys the paper upward to the image forming unit 8.

Structure of Image Forming Unit

The image forming unit 8 at least includes a process cartridge 14 positioned below the paper output tray 9 as shown in FIGS. 3A and 3B, and a fixing device 15 which is installed in advance in an installation space between the paper output tray 9 and the paper feed tray 6 so that it is arranged above the process cartridge 14. The process cartridge 14 is detachably mounted in the main body casing 2 from a detachment opening 5 of the main body casing 2 as seen in FIGS. 1 and 2.

Structure of Paper Output Tray

The paper output tray 9 is positioned in the main body casing 2 at the front side of the main body casing 2 with an installation space for the fixing device 15, etc. spaced apart from the paper feed tray 6. The bottom portion of the paper output tray 9 is positioned higher than the bottom portion of the paper feed tray 6. Provided below the paper output tray 9 is an installation space for the process cartridge 14, which constitutes the image forming unit 8. In other words, the lower portion (bottom portion) of the paper output tray 9 is positioned higher than the lower portion (bottom portion) of the paper feed tray 6.

The lower end portion of the front cover 4 is pivotally supported to the lower end portion of the paper output tray 9. When the upper end of the front cover 4 is lifted down in the forward direction, the front side of the paper output tray 9 is released so that the papers stored in the paper output tray 9 can be readily removed.

A recess 16 is formed in the rear wall of the paper output tray 9 at a vertically intermediate portion thereof. The recess 16 dents toward a space above the fixing device 15. Provided at the bottom portion of the recess 16 are a pair of paper output rollers 17, 17 for feeding a paper to the paper output tray 9. For the purpose of guiding the paper from the fixing device 15 to the pair of paper output rollers 17, 17, a paper guide 18 is formed in the main body casing 2. Further, a transfer belt 40 is provided in the recess 16 so as to support the trailing end of the paper and convey the same in the forward direction. The transfer belt 40 is provided at a front side of and adjacent to the paper output rollers 17, 17. A plurality of projections are formed on the surface of the transfer belt 40 such that the trailing end of the paper is properly supported and conveyed in the downward direction of the paper output tray 9.

Further, as seen in FIG. 1, a paper output opening 9A whose lateral width is greater than that of the paper (i.e., width of the paper in the direction orthogonal to the paper conveyance direction) is formed in the upper end of the paper output tray 9, so that papers can be removed also from this opening 9A.

Structure of Process Cartridge

Figure 4A:
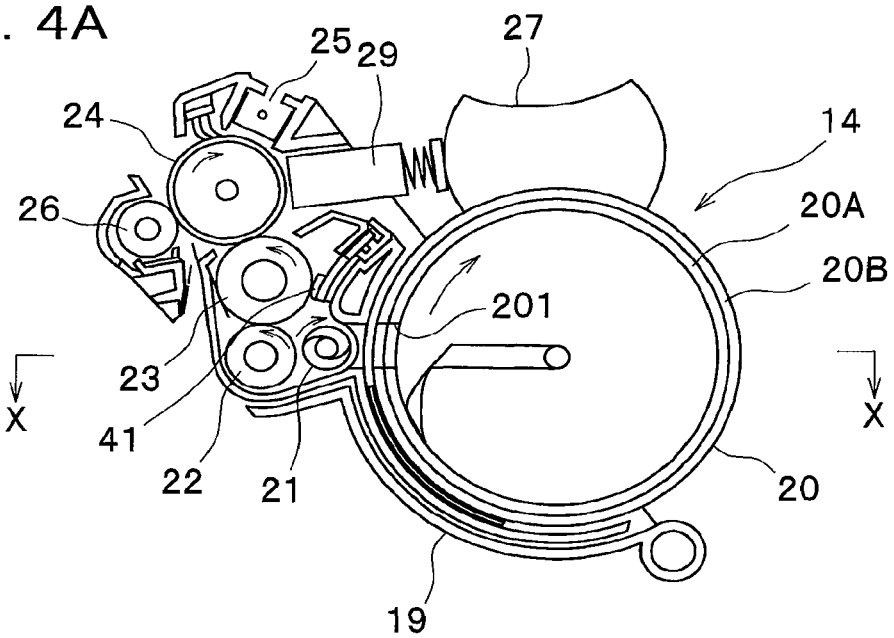
FIG. 4A is a sectional view of a process cartridge shown in FIGS. 3A and 3B.

As seen in FIG. 4A, the process cartridge 14 includes a toner cartridge 20 as a developer receptacle which is detachably mounted to the cartridge body 19. The process cartridge 14 also includes a toner feed auger 21, a feed roller 22, a developing roller 23, a photosensitive drum 24, a charger 25, and a transfer roller 26, which are installed in advance in the cartridge body 19.

Structure of Toner Cartridge

The toner cartridge 20 includes an inner cylinder 20A and an outer cylinder 20B, which are relatively rotatable to open/close a toner supply opening. As seen in FIG. 1, a logo 14A is denoted on an appropriate area of the outer cylinder 20B. As best seen in FIG. 3A, the paper feed tray 6 and the paper output tray 9 are arranged back and forth, and the toner cartridge 20 is positioned on the front side where the paper output tray 9 is arranged. The developer roller 23 as an example of a developer carrier is arranged farther from the front side in the front-back direction than the toner cartridge 20. This arrangement of the toner cartridge 20 and the developer roller 23 allows the toner cartridge 20 to be pulled out from the front side without interference with the developer roller 23.

Further, the toner cartridge 20 is supported on the cartridge body 19 such that the rotation shaft 42A of the agitator 42 is positioned ahead of the front surface of the front cover 4.

This support structure of the toner cartridge 20 allows most of the toner cartridge 20 to be exposed to view from the detachment opening 5 (see FIG. 1) in the forward direction (outside of the main body casing 2). Therefore, it is possible to restrict an installation space for the toner cartridge 20 within the main body casing 2, which leads to decreased size of the printer 1 in the vertical direction. As a result, the center of gravity of the printer 1 can be positioned as low as possible so as to reliably prevent the printer 1 from falling down, thereby leading to improved operationality of the printer 1.

Further, heat can be effectively released from the exposed portion of the toner cartridge 20 to outside. Therefore, it is possible to reliably prevent deterioration of the toner stored in the toner cartridge 20 due to heat generated at the fixing device 15.

Figure 4B:
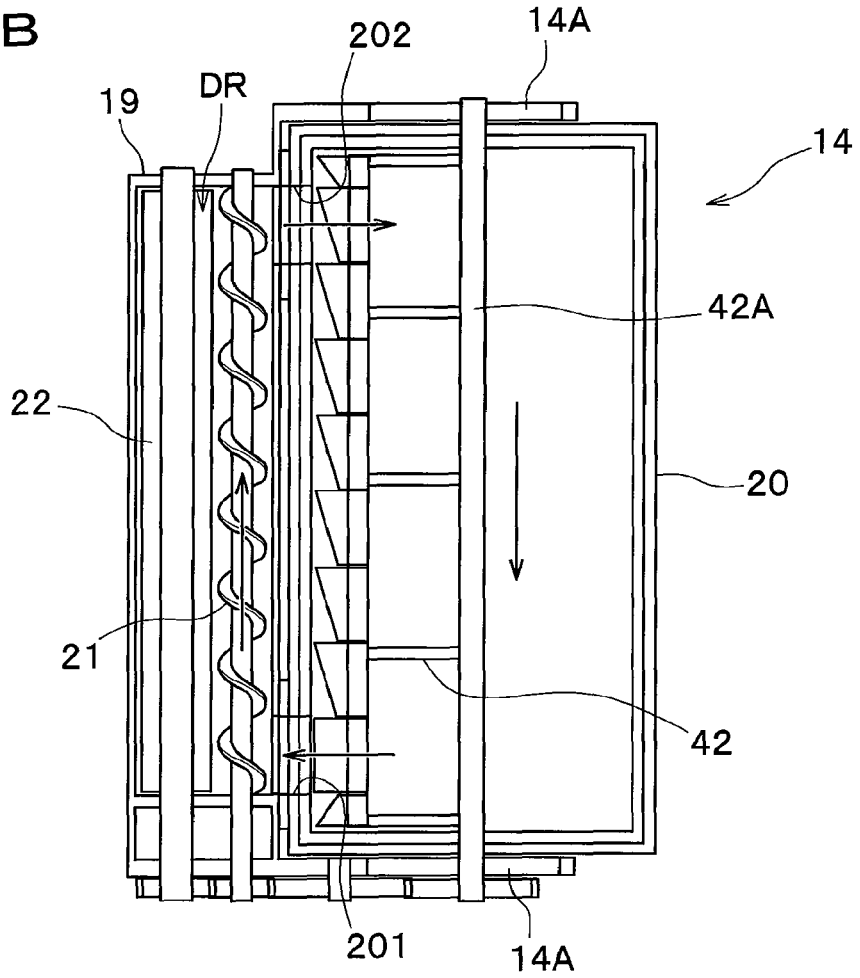
FIG. 4B is a sectional view taken along the line X-X of FIG. 4A.

As seen in FIG. 4B, a toner supply opening 201 is formed at one end of the toner cartridge 20 so that toner is fed through the toner supply opening 201 and into a development chamber DR that is defined in the cartridge body 19. Formed at the other end of the toner cartridge 20 is a toner return opening 202, through which toner is returned from the development chamber DR to the toner cartridge 20. An agitator 42 having a plurality of blades is provided in the toner cartridge 20 so that the toner stored in the toner cartridge 20 is agitated and supplied toward the one end of the toner cartridge 20.

Detachable Structure of Toner Cartridge

According to the toner cartridge 20 as described above, the rotational shaft 42A of the agitator 42 protrudes from both ends (right and left ends) of the toner cartridge 20 as shown in FIG. 3A. As best seen in FIG. 2, the rotational shaft 42A is bought into engagement with guide grooves 14B, 14B formed in appropriate positions of the process cartridge 14. The guide grooves 14B, 14B guide the toner cartridge 20 to a predetermined position of the process cartridge 14 to ease the attachment/detachment of the toner cartridge 20.

Further, as seen in FIG. 3B, the toner cartridge 20 can be separately removed from the cartridge body 19 when an operating handle 27 is operated at the predetermined position of the process cartridge 14 to rotate forward (to the front side) from the position shown in FIG. 3A to the position shown in FIG. 3B. On the contrary, when the operating handle 27 is rotated rearward (to the rear side) from the position shown in FIG. 3B to the position shown in FIG. 3A, the toner cartridge 20 can be attached to the cartridge body 19. In this attachment position, the logo 14A denoted on the toner cartridge 20 can be seen from the front side of the printer 1. To be more specific, when the toner cartridge 20 is in the attachment position as shown in FIG. 3A, the logo 14A is directed to the front side and therefore it can be easily seen from the front side. However, when the toner cartridge 20 is rotated from the attachment position, the logo 14A is directed to a diagonally lower direction as shown in FIG. 3B where the logo 14A is not clearly visible from the front side. Accordingly, the user can readily check whether the toner cartridge 20 is in the attachment position or not. Of course, any shape or character(s) can be used in place of the logo 14A.

Further, when the toner cartridge 20 is rotated from the position of FIG. 3B to the position of FIG. 3A, the toner cartridge 20 is brought into engagement with an engagement portion (not shown) of the cartridge body 19 to thereby complete the attachment to the cartridge body 19. An LED head array 29 is slidably supported in the main body casing 2. The LED head array 29 is slidable in the front-back direction, and is urged in the forward direction by a spring (not shown). When the toner cartridge 20 is in the attachment position, the operating handle 27 urges and pushes the LED head array 29 toward the photosensitive drum 24 as shown in FIG. 3A. In this position of the toner cartridge 20, a cushion spring provided at the front side of the LED head array 29 reduces a collision force between the LED head array 29 and the operating handle 27. When the toner cartridge 20 is rotated from the attachment position to a non-attachment position, as seen in FIG. 3B, the LED head array 29 is retracted to the front side so as to prevent an interference with the process cartridge 14 that is slidably guided along the detachment passage.

Detachable Structure of Process Cartridge

Figure 5:
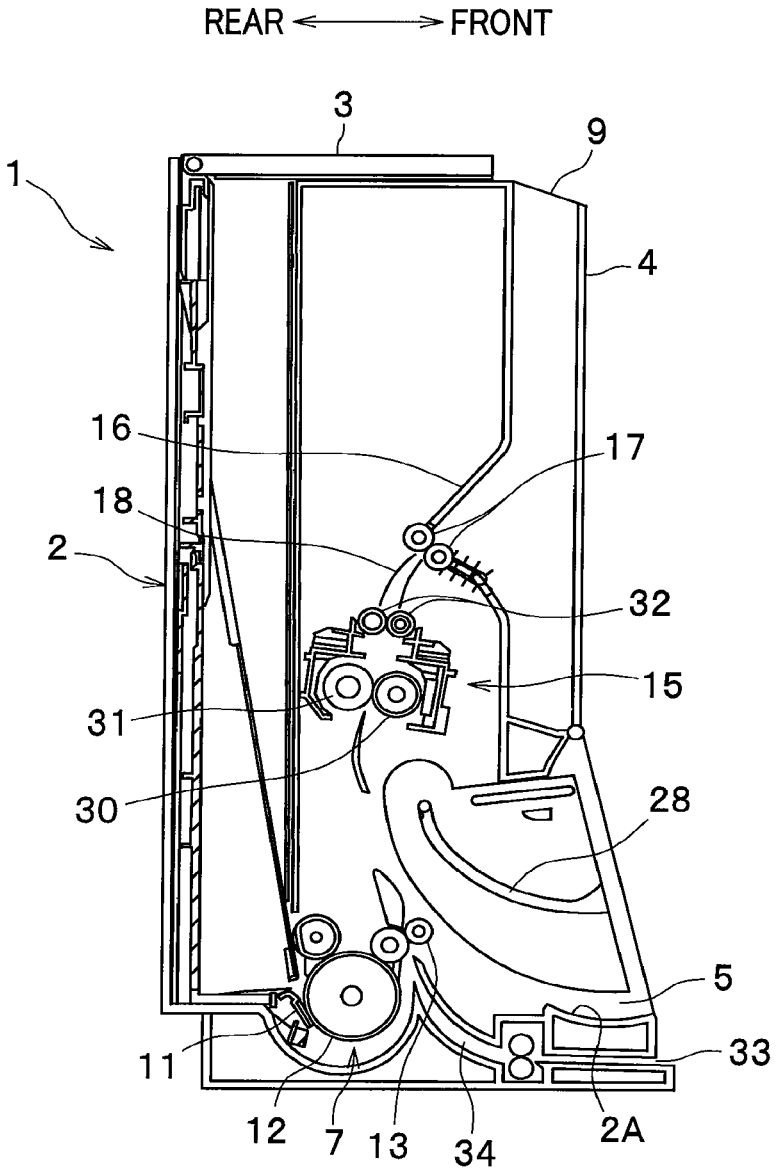
FIG. 5 is a vertical section of the printer showing a state where the process cartridge is removed from the main body casing.
Figure 6B:
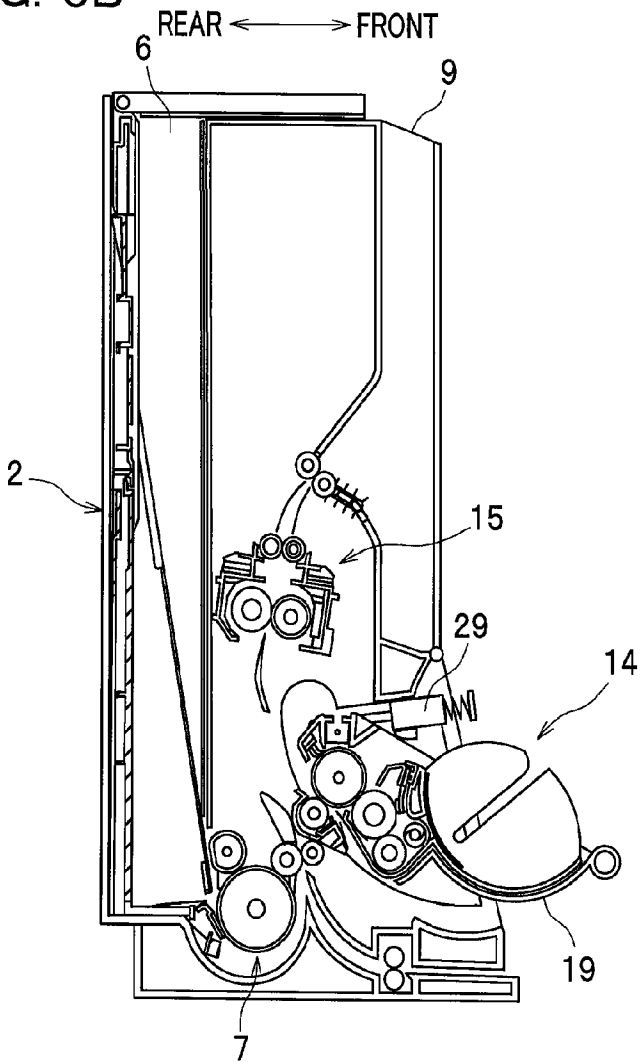
Figure 6A:
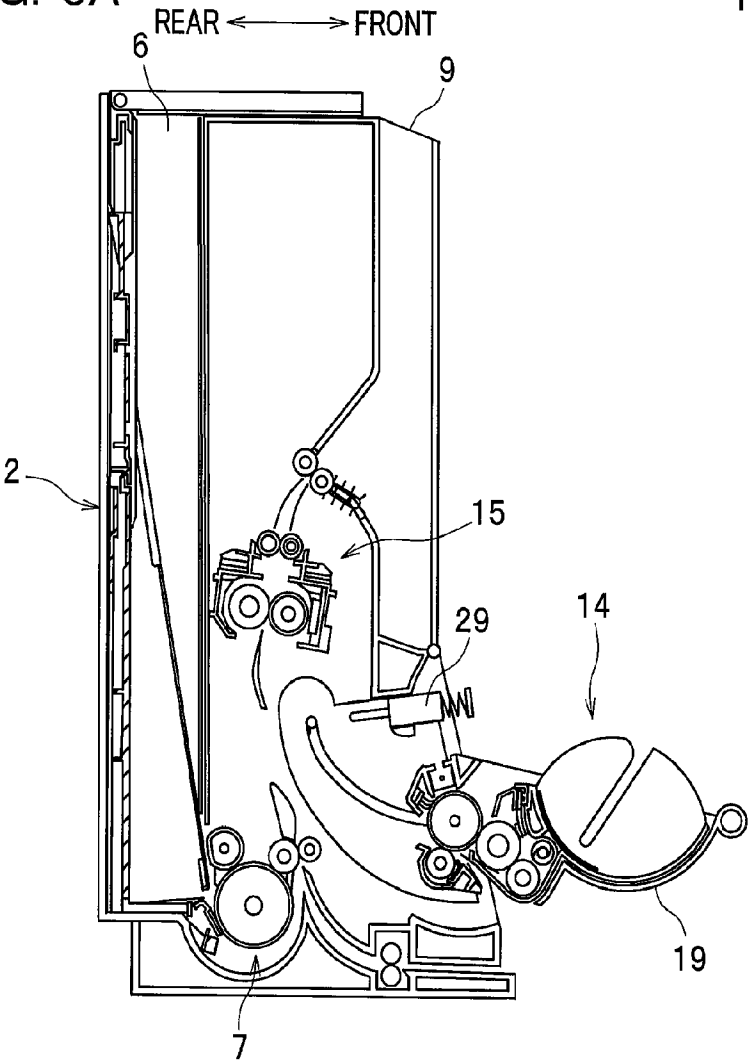
Figure 7B:
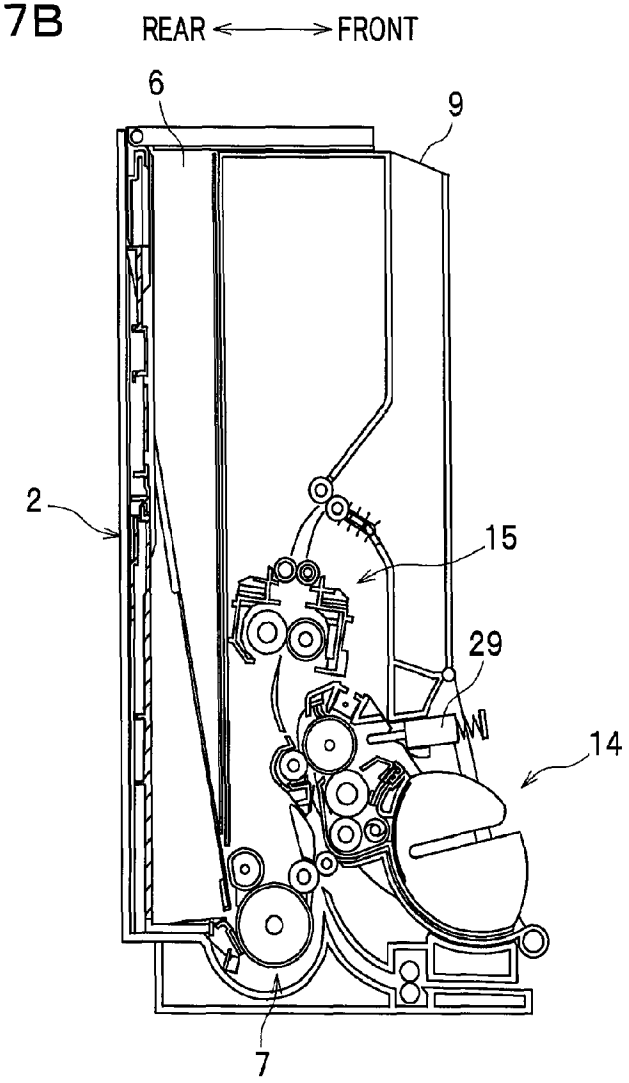
Figure 7A:
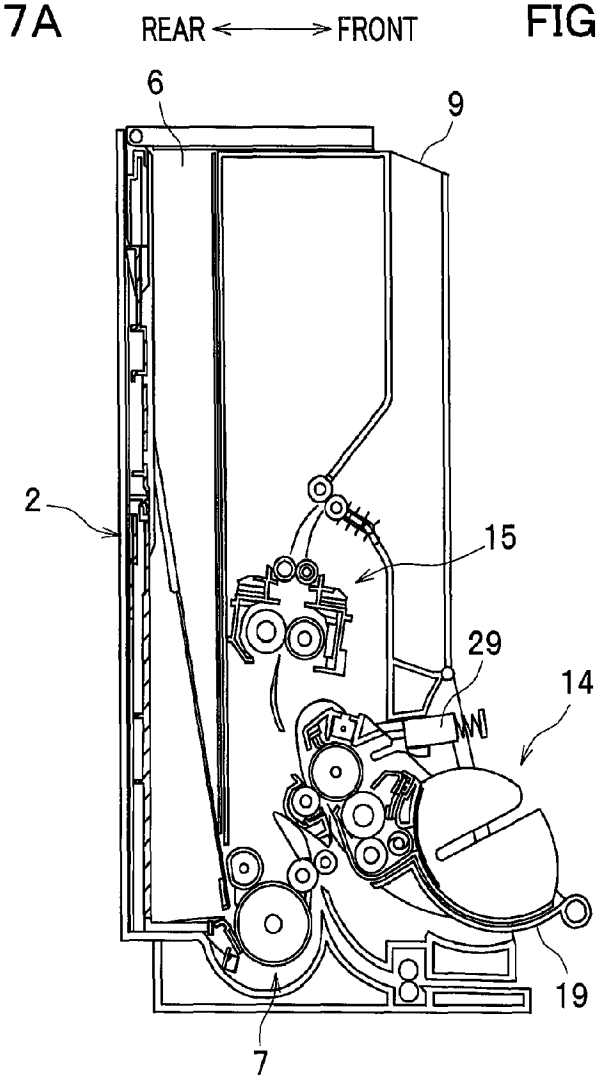

The process cartridge 14 is attached to and detachable from the main body casing 2 through the detachment opening 5 as shown in FIGS. 1 and 2. For this reason, as best seen in FIG. 5, a guide groove 28 is formed in the inner surfaces of the right and left side walls of the detachment opening 5 provided in the main body casing 2. Each guide groove 28 extends arcuately upward from the front side toward the rear side of the side wall. In conformity with the guide grooves 28, 28, the cartridge body 19 of the process cartridge 14 is provided with a pair of right and left guide pins (not shown), which protrude sideward and are slidably engageable with the corresponding guide grooves 28, 28. Further, corresponding to these guide pins (not shown), both ends of the rotational shaft 24A of the photosensitive drum 24 protrude sideward from the cartridge body 19, so that when the process cartridge 14 is attached to and detached from the main body casing 2, the both ends of the rotational shaft 24A are guided along the corresponding guide grooves 28, 28 as shown in FIG. 3A.

According to this detachable structure, the process cartridge 14 is inserted from the detachment opening 5 provided at the front side of the printer 1, and as seen in FIGS. 6A, 6B and FIGS. 7A, 7B, the process cartridge 14 is attached to a predetermined position in the main body casing 2. Upon attachment of the process cartridge 14, because a force applied by the user to the process cartridge 14 is directed to the upward direction by means of the upper shape of the guide grooves 28, 28, the vertically elongated shaped printer 1 is subject to less pressing force in the horizontal direction so that an attachment of the process cartridge 14 is stably performed. Upon detachment of the process cartridge 14, the process cartridge 14 is pulled out from the detachment opening 5 of the printer 1. Therefore, the process cartridge 14 is removed from the main body casing 2 in a stable manner while pressing the main body casing 2 in the downward direction. This can reliably prevent the printer 1 from falling down when the process cartridge 14 is attached to and detached from the main body casing 2, thereby leading to improved operationality of the printer 1.

As best seen in FIG. 5, the main body casing 2 is provided with a restriction wall 2A, which is partly engageable with the lower end of the process cartridge 14 to prevent the process cartridge 14 that has been attached to the main body casing 2 from being pulled out from the main body casing 2. Therefore, the process cartridge 14 is stably attached to the main body casing 2 by this restriction wall 2A.

Operation of Process Cartridge

As seen in FIG. 4B, toner stored in the toner cartridge 20 is carried to one end of the toner cartridge 20 by the agitator 42. Also, the agitator 42 supplies the toner that has been carried to the one end of the toner cartridge 20 from the toner supply opening 201 formed at the one end of the toner cartridge 20 to the development chamber DR defined in the cartridge body 19.

Further, the toner introduced into the development chamber DR is carried to the other end of the toner cartridge 20 by the toner feed auger 21. Therefore, toner is uniformly supplied on the surface of the feed roller 22 along the axial direction of the feed roller 22. The toner carried to the other end of the toner cartridge 20 within the development chamber DR is returned to the toner cartridge 20 through the toner return opening 202 formed in the other end of the toner cartridge 20.

The toner that is supplied to the surface of the feed roller 22 makes a frictional contact with the developing roller 23 and is charged positively. Therefore, the toner adheres and is deposited on the surface of the developing roller 24. A doctor blade 23 wipes off the deposited toner and restricts the thickness of the toner so that a thin toner layer having a constant thickness is formed on the developing roller 24.

The photosensitive drum 24 includes a photosensitive layer having positive charge characteristics. When the charger 25 generates and applies a corona discharge from a charge wire made of tungsten, etc., the photosensitive layer formed on the surface of the photosensitive drum 24 is uniformly charged in the plus polarity. The positively charged photosensitive layer on the photosensitive drum 24 is then exposed by the LED head array 29 supported in the main body casing 2 based on image data. This exposure process lowers the potential of an exposed area on the photosensitive layer, so that a latent image associated with the image data is formed on the photosensitive drum 24.

Plus charged toner carried on the developing roller 23 adheres to the latent image that is formed on the photosensitive layer of the photosensitive drum 24. By this reversal process, a toner image is formed on the photosensitive layer of the photosensitive drum 24. A paper is conveyed along the paper conveyance passage and passes between the photosensitive drum 24 which carries the toner image on the photosensitive layer and the transfer roller 26, during which the toner image is transferred on the paper. The transfer roller 26 includes a roller shaft, which is made of metal and covered with a rubber material. When a transfer bias is applied to the transfer roller 26, the toner image formed on the photosensitive drum 24 is transferred to the paper.

Structure of Fixing Device

As best seen in FIG. 5, the fixing device 15 includes a heating roller 30 and a pressure roller 31 which are positioned oppositely and rotate to pinch and convey a paper toward the paper output tray 9, and a pair of conveyance rollers 32, 32. The pair of conveyance rollers 32, 32 are positioned downstream of the paper conveyance passage from the heating roller 30 and the pressure roller 31. These conveyance rollers 32, 32 feed the paper along the paper guide 18 to the paper output rollers 17, 17 that are provided at the recess 16 of the paper output tray 9.

Operation of Fixing Device

A paper on which a toner image has been transferred between the photosensitive drum 24 and the transfer roller 26 in the process cartridge 14 is conveyed and passes between the heating roller 30 and the pressure roller 31 provided in the fixing device 15. During the conveyance of the paper the toner image formed on the paper is thermally fixed by the heating roller 30.

Paper Conveyance Passage

As seen in FIGS. 3A and 3B, the paper conveyance passage along which a paper is conveyed extends from the paper feed tray 6 toward the paper output tray 9. The paper conveyance passage has a substantially U-shaped configuration and protrudes downward from the paper feed tray 6 and the paper output tray 9. The paper conveyance passage is defined by a pick-up roller 11A, the separation roller 12, a paper guide 12A, the registration roller 13, the photosensitive drum 24 and the transfer roller 26, the heating roller 30 and the pressure roller 31, the conveyance rollers 32, 32, the paper guide 18, and the paper output rollers 17, 17. Of this conveyance passage, the passage from the lower end of the separation roller 12 to the paper output rollers 17, 17 is directed to the upward direction.

The substantially U-shaped paper conveyance passage directly connects the paper feed tray 6, the paper feed opening 6A, and the paper discharge opening (space between the paper output rollers 17, 17) of the paper output tray 9. Further, in this U-shaped paper conveyance passage, the vertical distance from the paper feed opening 6A of the paper feed tray 6 to the bottom portion of the conveyance passage (bottom portion of the paper guide 12A), which is also referred to as a "downward conveyance passage", is smaller than the vertical distance from the bottom portion of the conveyance passage to the paper discharge opening of the paper output tray 9, which is also referred to as an "upward conveyance passage". Therefore, the registration roller 13, the process cartridge 14, and the fixing device 15 can be arranged in this order along the upward conveyance passage.

According to this embodiment, the pick-up roller 11A is a roller for feeding a paper downward from the paper feed opening 6A. The paper guide 12A is arranged on the opposite side of the separation roller 12. The paper guide 12A is a U-shaped guide whose inner surface curves in conformity with the outer shape of the separation roller 12.

The paper conveyance passage having a substantially U-shaped configuration and protruding downward indicates that the paper conveyed from the paper feed tray 6 is guided downward and then the paper is reversed while the leading end of the paper is curved into a U-shape, and thereafter the paper is guided and conveyed upward. The separation roller 12 and the paper guide 12A disposed on the lower portion of the paper conveyance passage cause the paper conveyed from the paper feed tray 6 to be reversed in the front-back direction.

Structure of Manual Paper Feed Unit

As seen in FIG. 5, a manual paper feed opening 33 is formed below the detachment opening 5 of the main body casing 2, through which a paper is manually supplied from the front side of the printer 1. The manual paper feed opening 33 forms a continuous surface with a manual paper feed passage 34, which extends arcuately upward from a paper supply roller 13A (see FIG. 3A) to the registration roller 13, thereby providing a manual paper feed unit.

As described above, according to the printer 1 as an embodiment of the image forming apparatus, a paper stored in the paper feed tray 6 is conveyed to the paper output tray 9 through the separation roller 12, the registration roller 13, the photosensitive drum 24 and the transfer roller 26, the heating roller 30 and the pressure roller 31, the conveyance rollers 32, 32, the paper guide 18, and the paper output rollers 17, 17, in this order. During the conveyance of the paper, a toner image is formed on the paper by the image forming unit 8 which is positioned along the paper conveyance passage, and thereafter the toner image is thermally fixed on the paper by the fixing device 15.

Further, when a paper is inserted from the manual paper feed opening 33, the paper is guided along the manual paper feed passage 34 and supplied to the registration roller 13. The registration roller 13 conveys the paper to the image forming unit 8 and the fixing device 15, at which a toner image is formed and thermally fixed on the paper. After the toner image is formed and thermally fixed on the paper, the paper is discharged and stored in the paper output tray 9.

According to the printer 1, because the fixing device 15 is arranged above the process cartridge 14 as a developer unit which comprises the developing roller 23, etc., the process cartridge 14 is not heated by the heat generated and rising from the heating roller 30 of the fixing device 15. The heat rising from the heating roller 30 of the fixing device 15 passes through the paper guide 18 and the paper discharge opening of the paper output tray 9 and goes through the paper output tray 9 and is smoothly discharged into the air. Heat that is not discharged from the paper discharge opening is gradually cooled in the space defined above the fixing device 15 within the main body casing 2. A heat release opening may be formed in the upper part of the main body casing 2.

Namely, according to the printer 1, heat deterioration of toner can be prevented in the process cartridge 14. As a result, a high-quality toner image can be formed on a paper.

According to the printer 1, the paper conveyance passage extends upward from the lower portion of the paper feed tray 6 toward the paper output tray 9. This is advantageous because the size of the whole apparatus can be reduced in the vertical direction when compared with the conventional image forming apparatus in which the paper conveyance passage extends downward from the lower part of the paper feed tray.

In other words, the substantially U-shaped paper conveyance passage is configured such that upward conveyance passage is longer in the vertical distance than the downward conveyance passage. This is advantageous because it is possible to prevent an increase in the vertical size of the structure around the paper feed tray 6, and the paper output tray 6 can be positioned as low as possible in the main body casing 2, when compared with the conventional image forming apparatus in which the upward conveyance passage is shorter in the vertical distance than the downward conveyance passage. Therefore, the user can easily load papers into the paper feed tray 6 and the operationality of the printer 1 increases as a result.

Especially, according to this embodiment, papers are loaded in the paper feed tray 6 after the user pulls out the paper feed tray 6 upward from the main body casing 2. Therefore, the user can easily pull out the paper feed tray 6 upward from the main body casing 2 because the paper feed tray 6 is positioned as low as possible, thereby allowing the user to readily perform the paper loading operation.

Further, as seen in FIG. 1, the paper output opening 9A is formed at the upper end of the paper output tray 9 so that discharged papers can be stored in the paper output tray 9 with the upper ends thereof protruding from the opening 9A. This is advantageous because the height of the paper output tray 9 is restricted as low as possible, and papers protruding from the paper output opening 9A of the paper output tray 9 can be readily removed by directly pulling them in the upward direction. Further, inserting the user's fingers into the paper output opening 9A and holding the upper end of the front cover 4 allows the user to readily release the front cover 4. As a result, it is possible to improve the operationality of the printer 1. Especially, the upper end of the paper output tray 9 and the upper end of the paper feed tray 6 are substantially at the same height in the vertical direction, so that the paper feed tray 6 is readily pulled out from the main body casing 2 when compared with the configuration in which the paper output tray 9 protrudes upward to a greater extent from the paper feed tray 6.

Papers stored in the paper feed tray 6 may not be conveyed reliably if the papers are bent or wrinkles are formed on the papers due to absorption of moisture. For this reason, in order to prevent papers from being bent, it is preferable that the paper feed tray 6 has a height longer than the height (length in the conveyance direction) of the papers to be stored therein. It is also preferable that the main body casing 2 surrounds all-around surfaces of the papers in order to shut out moisture.

On the contrary, the above drawbacks do not occur in the paper output tray 9. Therefore, it is possible to form the paper output opening 9A at the upper end of the paper output tray 9 so that papers protrude from the paper output opening 9A.

Further, the bottom portion of the paper output tray 9 is positioned lower than the paper discharge opening, so that a sufficient height of the paper output tray 9 is ensured for supporting discharged papers in the tray 9 without protruding the paper output tray 9 upward to a greater extent from the main body casing 2.

According to the printer 1, the manual paper feed operation, the attachment and detachment of the process cartridge 14, the attachment and detachment of the toner cartridge 20, and the removal of papers from the paper output tray 9 are all performed from the front side of the printer 1, thereby leading to improved operationality. Further the paper feed tray 6 can be pulled out upward from the main body casing 2. Therefore, papers can be supplied from above the main body casing 2 as well as from the front side, leading to improved operationality.

Further, the process cartridge 14 is arranged below the paper output tray 9 by effectively utilizing a dead space. This can advantageously prevent an increase in the depth (width in the front-back direction) of the printer 1. Further, because the process cartridge 14 is detachable from the front side of the printer 1 through the detachment opening 5, attachment and detachment of the process cartridge 14 can be readily performed.

Furthermore, the detachment passage for the process cartridge 14 extends gradually arcuately upward from the front side toward the rear side of the printer 1. Therefore, attachment and detachment of the process cartridge 14 can be stably and smoothly performed.

The toner cartridge 20 is separately detachable from the process cartridge 14 (developer unit) through the detachment opening 5 provided on the front side of the printer 1.

This makes it possible to readily perform attachment and detachment of the toner cartridge 20.

The toner cartridge 20 is exposed to view from the front side of the printer 1, and the logo 14A is denoted on the front surface of the toner cartridge 20. Therefore, the logo 14A becomes visible from the front side of the printer 1.

Although the present invention has been described in detail with reference to the above preferred embodiment, the present invention is not limited to this specific embodiment and various changes and modifications may be made without departing from the scope of the appended claims.

In the above preferred embodiment, the present invention has been applied to the printer 1. However, the present invention may be applicable to other image forming apparatus such as a copying machine and a multifunction device.

In the above preferred embodiment, the developing roller 23 is employed as the developer carrier. However, the present invention is not limited to this specific embodiment, and, for example, a belt for carrying toner may be employed.

Further, in the above preferred embodiment, as an example of the developer unit, the process cartridge 14 includes the photosensitive drum 24, the toner cartridge 20, etc. in addition to the developing roller 23. However, the present invention is not limited to this specific embodiment. For example, the developer unit may consist of a cartridge body 19 in which the toner cartridge 20 is excluded from the process cartridge 14. Also, in the case where the cartridge body 19 is separable between the photosensitive drum 24 and the developing roller 23, a unit including the developing roller 23, i.e., a developer cartridge, may be defined as the developer unit.

What is claimed is:

1. An image forming apparatus comprising:

an inlet through which a recording sheet is to be inputted;

an image forming unit including a photosensitive drum and a toner cartridge, the toner cartridge configured to be attached to and detached from the image forming apparatus while the photosensitive drum is installed in the image forming apparatus, the image forming unit configured to form a developer image on a recording sheet inputted through the inlet and conveyed along a first conveying path along which the recording sheet is conveyed in an upward direction;

a cartridge guide comprising a guide start portion, an arcuate guide portion, and a guide end portion, the cartridge guide being configured to guide the image forming unit such that the image forming unit is movable relative to the first conveying path from the guide start portion to the guide end portion through the arcuate guide portion;

a fixing device disposed above the image forming unit and configured to fix the developer image, which is formed by the image forming unit, on the recording sheet;

an LED array disposed at a position opposite to the first conveying path in a horizontal direction relative to the photosensitive drum and opposite to the inlet in a vertical direction relative to the image forming unit, the LED array configured to expose the photosensitive drum of the image forming unit, the LED array, the LED array configured to move in the horizontal direction toward the photosensitive drum into an attachment position when the toner cartridge is attached to the image forming apparatus in which the photosensitive drum is installed, and the LED array configured to move in the horizontal direction away from the photosensitive drum into a non-attachment position when the toner cartridge is detached from the image forming apparatus in which the photosensitive drum is installed; and a recording sheet receiving unit configured to receive the recording sheet conveyed from the image forming unit, wherein the cartridge guide is curved such that the image forming unit is movable around the LED array, wherein the guide start portion extends substantially horizontally in a direction substantially parallel to the horizontal direction.

2. The image forming apparatus according to claim 1, further comprising a recording sheet storage unit that overlaps the image forming unit as viewed in the horizontal direction and is configured to store a recording sheet to be fed to the image forming unit.

3. The image forming apparatus according to claim 2, wherein the recording sheet storage unit is configured to store the recording sheet substantially in an upright position.

4. The image forming apparatus according to claim 1, wherein the LED array is configured to, when the LED array is moved away from the photosensitive drum, allow the image forming unit to move away from the first conveying path.

5. The image forming apparatus according to claim 1, wherein the cartridge guide is curved such that the image forming unit is movable between the LED array and the inlet.

6. The image forming apparatus according to claim 1, wherein the image forming unit comprises one or more guide pins that are slidably engageable with the cartridge guide.

7. The image forming apparatus according to claim 6, wherein the cartridge guide comprises one or more grooves configured to respectively receive the one or more guide pins of the image forming unit.

8. The image forming apparatus according to claim 1, wherein the image forming unit is configured to be attached to the image forming apparatus via the cartridge guide.

9. The image forming apparatus according to claim 1, wherein the toner cartridge comprises an operating handle, wherein the operating handle is configured to urge the LED array toward the photosensitive drum in the case that the toner cartridge is in the attachment position.

10. An image forming apparatus comprising:

an inlet through which a recording sheet is to be inputted;

an image forming unit including a photosensitive drum and a toner cartridge, the toner cartridge configured to be attached to and detached from the image forming apparatus while the photosensitive drum is installed in the image forming apparatus, the image forming unit configured to form a developer image on a recording sheet fed from the inlet and conveyed along a first conveying path along which the recording sheet is conveyed;

a fixing device configured to fix the developer image, which is formed by the image forming unit, on the recording sheet;

an LED array disposed at a position opposite to the first conveying path relative to the photosensitive drum and configured to expose a photosensitive drum of the image forming unit, the LED array configured to move toward the photosensitive drum into an attachment position when the toner cartridge is attached to the image forming apparatus in which the photosensitive drum is installed, and the LED array configured to move away from the photosensitive drum when the toner cartridge is detached from the image forming apparatus in which the photosensitive drum is installed; and a recording sheet receiving unit configured to receive the recording sheet conveyed from the image forming unit.

11. The image forming apparatus according to claim 10, wherein the first conveying path extends in an upward direction, and the fixing device is disposed above the image forming unit.

12. The image forming apparatus according to claim 11, wherein the LED array is configured to move in a horizontal direction toward and away from the photosensitive drum.

13. The image forming apparatus according to claim 12, further comprising a recording sheet storage unit that overlaps the image forming unit as viewed in the horizontal direction and is configured to store a recoding sheet to be fed to the image forming unit.

14. The image forming apparatus according to claim 12, wherein the recording sheet storage unit is configured to store the recording sheet substantially in an upright position.

15. The image forming apparatus according to claim 10, wherein the LED array is configured to, when the LED array is moved away from the photosensitive drum, allow the image forming unit to move away from the first conveying path.

16. The image forming apparatus according to claim 10, wherein the toner cartridge comprises an operating handle, wherein the operating handle is configured to urge the LED array toward the photosensitive drum in the case that the toner cartridge is in the attachment position.

* * * * *